US008410990B2

(12) United States Patent
Kazanchian

(10) Patent No.: US 8,410,990 B2
(45) Date of Patent: Apr. 2, 2013

(54) ANTENNA WITH INTEGRATED RF MODULE

(76) Inventor: Armen E. Kazanchian, Hermosa Beach, CA (US)

( * ) Notice: Subject to any disclaimer, the term of this patent is extended or adjusted under 35 U.S.C. 154(b) by 738 days.

(21) Appl. No.: 12/621,723

(22) Filed: Nov. 19, 2009

(65) Prior Publication Data

US 2010/0066625 A1 Mar. 18, 2010

Related U.S. Application Data

(63) Continuation-in-part of application No. 11/958,102, filed on Dec. 17, 2007, now abandoned.

(60) Provisional application No. 61/116,600, filed on Nov. 20, 2008.

(51) Int. Cl.
*H01Q 1/52* (2006.01)

(52) U.S. Cl. ..... 343/841

(58) Field of Classification Search ..... 343/790, 343/792, 793, 841

See application file for complete search history.

(56) References Cited

U.S. PATENT DOCUMENTS

| | | | | |
|---|---|---|---|---|
| 3,946,391 | A * | 3/1976 | Cuckler et al. | 343/709 |
| 5,198,831 | A | 3/1993 | Burrell et al. | |
| 5,995,063 | A | 11/1999 | Somoza et al. | |
| 6,366,261 | B1 | 4/2002 | Stout et al. | |
| 6,369,776 | B1 | 4/2002 | Leisten et al. | |
| 6,552,693 | B1 | 4/2003 | Leisten | |
| 7,002,530 | B1 | 2/2006 | Chung et al. | |
| 7,079,664 | B2 | 7/2006 | Nassimi | |
| 7,239,286 | B1 | 7/2007 | Miller et al. | |
| 7,268,745 | B2 | 9/2007 | Yang et al. | |
| 2004/0189543 | A1 | 9/2004 | Jordan et al. | |
| 2008/0012788 | A1 * | 1/2008 | Brocheton et al. | 343/906 |

FOREIGN PATENT DOCUMENTS

WO WO2006108289 A1 10/2006

* cited by examiner

*Primary Examiner* — Robert Karacsony
(74) *Attorney, Agent, or Firm* — Alvin R. Wirthlin

(57) ABSTRACT

An antenna assembly includes an antenna housing, an antenna located within the housing, a radio frequency (RF) module located within the housing and connected to the antenna, and a wire assembly operably associated with the module. The module includes a radio frequency device, such as a transmitter, receiver or transceiver, electrically connected to the antenna. The wire assembly includes electrical wires for providing external power to the module and conducting processed signals between the module and external circuitry. The proximal nature of the antenna and RF module reduces or eliminates induced power losses between the antenna and module, resulting in a very effective power transfer ratio. A conductive sleeve is located in the housing and surrounds the RF module. The conductive sleeve is electrically connected to the module to thereby provide a ground plane for the antenna and a shield against outside emissions. A spacer located between the sleeve and the mounting base together with a step between the sleeve and the wire assembly provide a choke effect for the RF energy.

20 Claims, 10 Drawing Sheets

ANTENNA WITH INTEGRATED RF MODULE

CROSS REFERENCE TO RELATED APPLICATIONS

This application claims the benefit of U.S. Provisional Application No. 61/116,600 filed on Nov. 20, 2008, the subject matter of which is hereby incorporated by reference. This application is also a continuation-in-part of U.S. application Ser. No. 11/958,102 filed on Dec. 17, 2007.

BACKGROUND OF THE INVENTION

This invention relates generally to antennas, and more particularly to an antenna having an integrated radio frequency (RF) module.

RF modules, such as transceivers, transmitters and receivers, are employed in many different products, including mobile phones, personal computers, wireless networks, gaming devices, wireless sensors, radios, walkie-talkies, and so on. Consumer demand for more compact wireless products has caused many manufacturers to move the antenna to the inside of the product's enclosure, but not without compromise. For example, the enclosure must be constructed of plastic or other materials transparent to radiation in order to obtain the effective transmission or reception of signals. Also, the location of the antenna within the enclosure is limited since the user's hand may cover the antenna and therefore limit transmission and/or reception. In many cases, the internally mounted antenna cannot match the performance of an externally mounted antenna. Some devices include an RF module with a wire antenna that is wrapped somewhere inside the enclosure. However, these devices still suffer from the hand effect and cannot work inside metal enclosures.

When the antenna is mounted outside of the enclosure, a coaxial cable typically must extend between the external antenna and the RF module mounted on the user's product application board inside the enclosure. This cable has a loss associated with it that reduces the amount of energy transmitted between the antenna and the RF module. In addition, the cost of the cable, RF connectors and labor associated with assembling the external antenna can be prohibitive in many applications. Although there are antennas that directly mount to the RF modules, these types of devices require the use specialized connectors which again produce loss and are expensive. In addition, some devices include an external rubber duck-type antenna with a screw terminal that connects to the internal RF module and to the wall of the enclosure.

It would therefore be desirable to provide an external antenna with an integrated RF module that overcomes at least some of the disadvantages of the prior art.

BRIEF SUMMARY OF THE INVENTION

According to one aspect of the invention, an antenna assembly includes an antenna housing, an antenna located within the housing, a radio frequency module located within the housing, and at least one electrical conductor operably associated with the module. The module includes a radio frequency device selected from the group of transmitters, receivers and transceivers electrically connected to the antenna. At least one electrical conductor is operably associated with the module for conducting processed signals between the module and external circuitry without significant signal loss. A mounting base is connected to the housing for connecting the antenna assembly to an enclosure. The at least one electrical conductor extends through the mounting base. A conductive sleeve is located in the housing and surrounds the module. The conductive sleeve is electrically connected to the module to thereby provide a ground plane for the antenna and a shield against outside emissions. A spacer located between the housing and the mounting base for providing a radio frequency energy choke effect.

According to a further aspect of the invention, an antenna assembly includes a conductive sleeve, a radio frequency device located within the conductive sleeve and electrically connected thereto, the radio frequency device being selected from the group of transmitters, receivers and transceivers, and an antenna electrically connected to the radio frequency device. The antenna together with the conductive sleeve forms a dipole antenna. At least one electrical conductor is operably associated with the radio frequency device and extends coaxial with the conductive sleeve for conducting processed signals between the radio frequency device and external circuitry without significant signal loss. A step is formed between the conductive sleeve and the at least one electrical conductor to thereby create discontinuity in the flow of radio frequency energy from the dipole antenna.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

Figure 1:
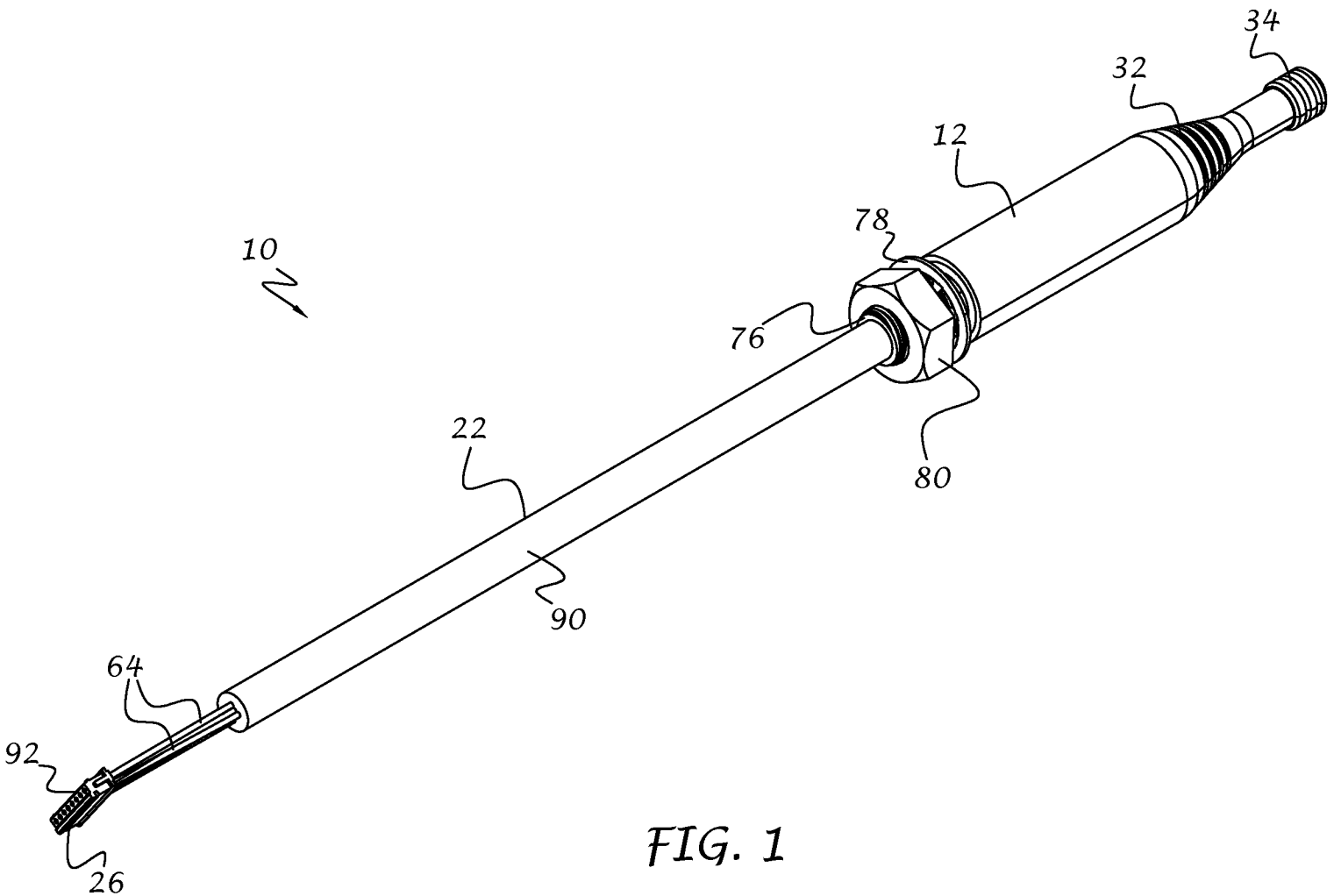
FIG. 1 is an isometric view of an antenna assembly with integrated RF module in accordance with the invention.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Referring now to the drawings, and to FIGS. 1-5 in particular, an antenna assembly 10 in accordance with the present invention is illustrated. The antenna assembly 10 can be adapted for use with any type of wireless device where the transmission and/or reception of signals is desired, including but not limited to: mobile phones, personal computers, wireless networks, gaming devices, wireless sensors, radios, walkie-talkies, transponders, and so on.

Figure 5:
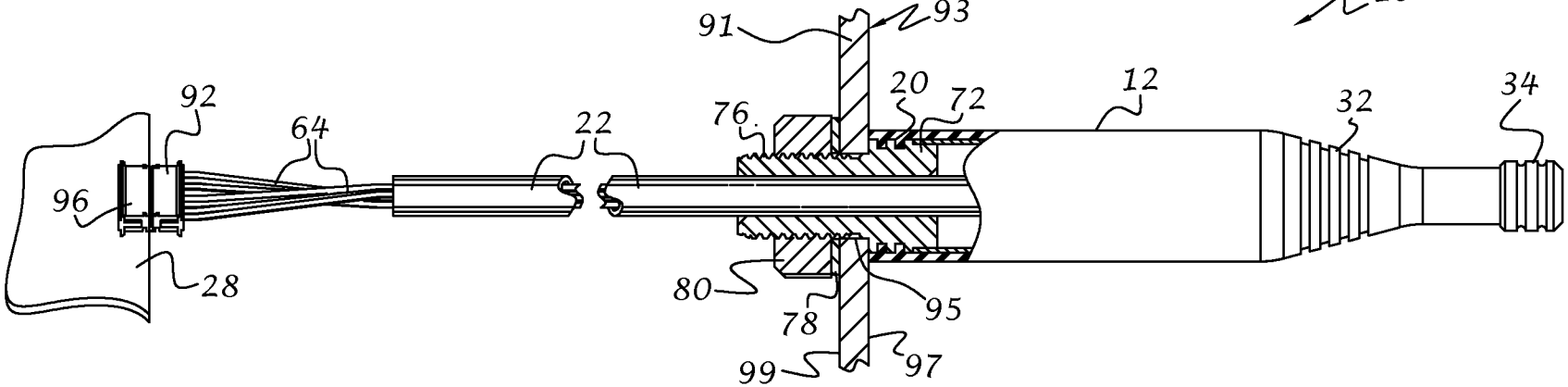
FIG. 5 is a sectional view of the antenna connected to a panel and further electrical circuitry.

The antenna assembly 10 preferably includes an antenna housing 12, a sleeve 14 located within the housing, a radio frequency (RF) module 16 located within the sleeve 14, and an antenna 18 extending forwardly from the module 16. A mounting base 20 extends into the housing 12 and sleeve 14. A wire assembly 22 extends through the base 20 and includes a distal end 24 that electrically connects to the module 16 and a proximal end 26 for connection to exterior circuitry 28 (FIG. 5). A volume 25 of potting material is positioned within the sleeve 14 and extends around the RF module 16 for both reinforcing the sleeve and providing shock absorption for the RF module.

The housing 12 is preferably in the form of an outer flexible boot with a continuous wall 30 of generally cylindrical configuration that tapers into a frusto-conical portion 32 and terminates in a cap 34 at a distal end thereof. The housing 12 can be constructed of an elastomeric material or other RF transparent material and is preferably directly molded onto the antenna 18, sleeve 14 and base 20 through an overmolding process during assembly. The housing 12 protects these components from outside environmental conditions.

The sleeve 14 as shown is preferably of hollow cylindrical configuration and includes a continuous wall 36 that defines an interior 38 for receiving the RF module 16. Opposing slots 40, 42 are formed in the wall 36 and extend from a proximal end 44 of the wall in an axial direction. The sleeve 14 is preferably constructed of an electrically conductive material, such as brass or aluminum, for mounting the RF module 16 directly to the sleeve. The sleeve 14 also serves as a ground plane for the antenna 18 and a shield for the RF module 16 to protect the RF module from outside emissions that may otherwise impact the electronics as well as spurious emissions that may occur from the module itself. For some applications, such as transmission and/or reception in the 2.4 GHz range, the sleeve 14 is approximately 1.15 inches in length. However, it will be understood that the sleeve 14 can be longer or shorter depending on the particular application. It will be further understood that the sleeve 14 can be constructed and/or coated with other conductive materials.

The RF module 16 preferably includes a radio frequency device 46, such as a miniature integrated circuit (IC) transceiver, receiver and/or transmitter, mounted on a printed circuit board (PCB) 48. The PCB is elongate in shape and preferably includes laterally extending tabs 50 and 52 with electrically conductive pads 54 and 56, respectively, formed at a proximal end 58 of the PCB. The pads are preferably associated with ground on the PCB through traces, jumpers or the like (not shown). The tabs with accompanying pads 54 and 56 are received within the slots 40 and 42, respectively, and electrically connected to the sleeve 14 through soldering or other well known electrical connecting means. A gap 60 is also formed at the proximal end 58 of the PCB 48 between the pads 54 and 56 for receiving the distal end 24 of the wire assembly 22. A plurality of electrical pads 62 are formed on the PCB 48 for receiving individual wires 64 of the wire assembly 22 through soldering or other well known electrical connecting means so that the wires are electrically connected to the PCB. It will be understood that the pads 62 can be replaced with plated thru holes or the like. A plated thru hole 66 is preferably formed at the distal end 68 of the PCB 48.

The antenna 18 preferably comprises a short length of stranded electrical wire 71 surrounded by an insulative jacket 73. A proximal end 70 of the antenna 18 is soldered to the thru-hole 66 of the PCB 48. For some applications, such as transmission/reception in the 2.4 GHz range, the antenna 18 can be formed of a 20 AWG electrical wire that is approximately 1.15 inches that, in conjunction with the sleeve 14 of similar length, create an ideal half-wave antenna. However, it will be understood that the wire can be of any size and length depending on the particular application. It will be further understood that the antenna can alternatively comprise a bare or insulated solid or stranded wire or cable. By way of example, for 868 or 900 MHz bands an antenna 18 and sleeve 14 may be similarly sized or longer in length to accommodate the longer wavelength of 900 MHz. For example, an antenna 18 of about three inches in length may be provided. Likewise, for 433 MHz transmission, an antenna having a length of seven inches may be provided.

Electrical traces as well as other electrical components (not shown) are located on the PCB 48 to electrically connect different ports of the transceiver 46 to the antenna 18, the sleeve 14, and the pads 54, 56 and 62. In accordance with one preferred embodiment, a microprocessor 65 (FIG. 4) is preferably located on the PCB 48 to process incoming and/or outgoing signals from the transceiver 46. In accordance with a further embodiment, the microprocessor may be eliminated from the PCB and associated with the exterior circuitry 28 (FIG. 5). Preferably, one of the pads 62 is associated with a source of DC power and another of the pads is associated with ground through the wires 64 and the exterior circuitry 28, including the pads 54 and 56. The remaining pads 62 are preferably associated with processed signals communicated from the transceiver 46 and/or the processor 65 to the exterior circuitry 28.

The mounting base 20 preferably includes a plug portion 72 with an annular boss 74 that fits snugly into the proximal end 44 of the sleeve 14 and a threaded portion 76 that receives a lock washer 78 and a threaded nut 80. A bore 82 extends through the mounting base 20 for receiving the wire assembly 22. The plug portion 72 also preferably includes a plurality of annular grooves 84, 86 for securing the proximal end 88 of the outer jacket 12 to the mounting base 20.

The mounting base 20 is preferably constructed of an electrically conductive material, such as brass or aluminum, so that it is in electrical contact with the sleeve 14 which is in turn in electrical contact with ground associated with the PCB 48, as previously described. With this arrangement, when the antenna assembly 10 is mounted onto a metal enclosure, the surface area of the ground plane is extended to thereby improve antenna performance. If transmission/reception occurs at a lower frequency than the 2.4 GHz example above, say at 900 MHz or 433 MHz, then the length of the sleeve 14 together with the length of the conductive mounting base outside the sleeve and the metal enclosure greatly improves the signal strength without significantly increasing the antenna size.

When the provision of a metal enclosure is impractical, and where it is desirous to keep the antenna to a minimum length, the mounting base 20 may be connected to an L bracket or metal pipe (not shown) to serve as a larger ground plane. In addition, the mounting base 20 could be connected to an adaptor (not shown) which has a plurality of antenna elements spreading away from the ground to serve as a radiation director for the RF signals.

The wire assembly 22 preferably includes an outer sheath 90 that surrounds the wires 64 and a connector 92 electrically connected to the wires 64 at the proximal end 94 of the wire assembly 22. It will be understood that the outer sheath 90 can be eliminated without departing from the spirit and scope of the present invention. It will also be understood that the wire assembly 22 may be in the form of a ribbon cable or the like. In any event, the connector 92 preferably mates with a corresponding connector 96 (FIG. 5) associated with the external circuitry 28 for receiving processed signals from the transceiver 46 and/or processor 65 and supplying power and ground to the PCB 48. Although the wire assembly 22 is shown with eight wires and the PCB is shown with eight corresponding pads, it will be understood that more or less wires and pads may be provided depending on the type of information that will be transferred between the external circuitry 28 and the transceiver 46. It will be further understood that the connector 92 may be removed or replaced with other types of connectors, as will be further described.

As shown in FIG. 5, the antenna assembly 10 is connected to the panel 91 of an enclosure or compartment 93 by inserting the wire assembly 22 and the threaded portion 76 of the mounting base 20 through an opening 95 in the panel until the plug portion 72 abuts an outer surface 97 of the panel. The lock washer 78 and nut 80 are then installed on the threaded portion 76 and tightened against the inner surface 99 to securely connect the antenna assembly 10 to the enclosure 93. The wire assembly 22 can then be connected to the circuitry 28 as previously described. It will be understood that the mounting base 20 and/or lock washer 78 and nut 80 can be replaced with any type of connecting means such as panel mount or bulkhead connectors, magnetic bases, suction cups, clips, clamps, adhesives, welding, and so on.

Figure 2:
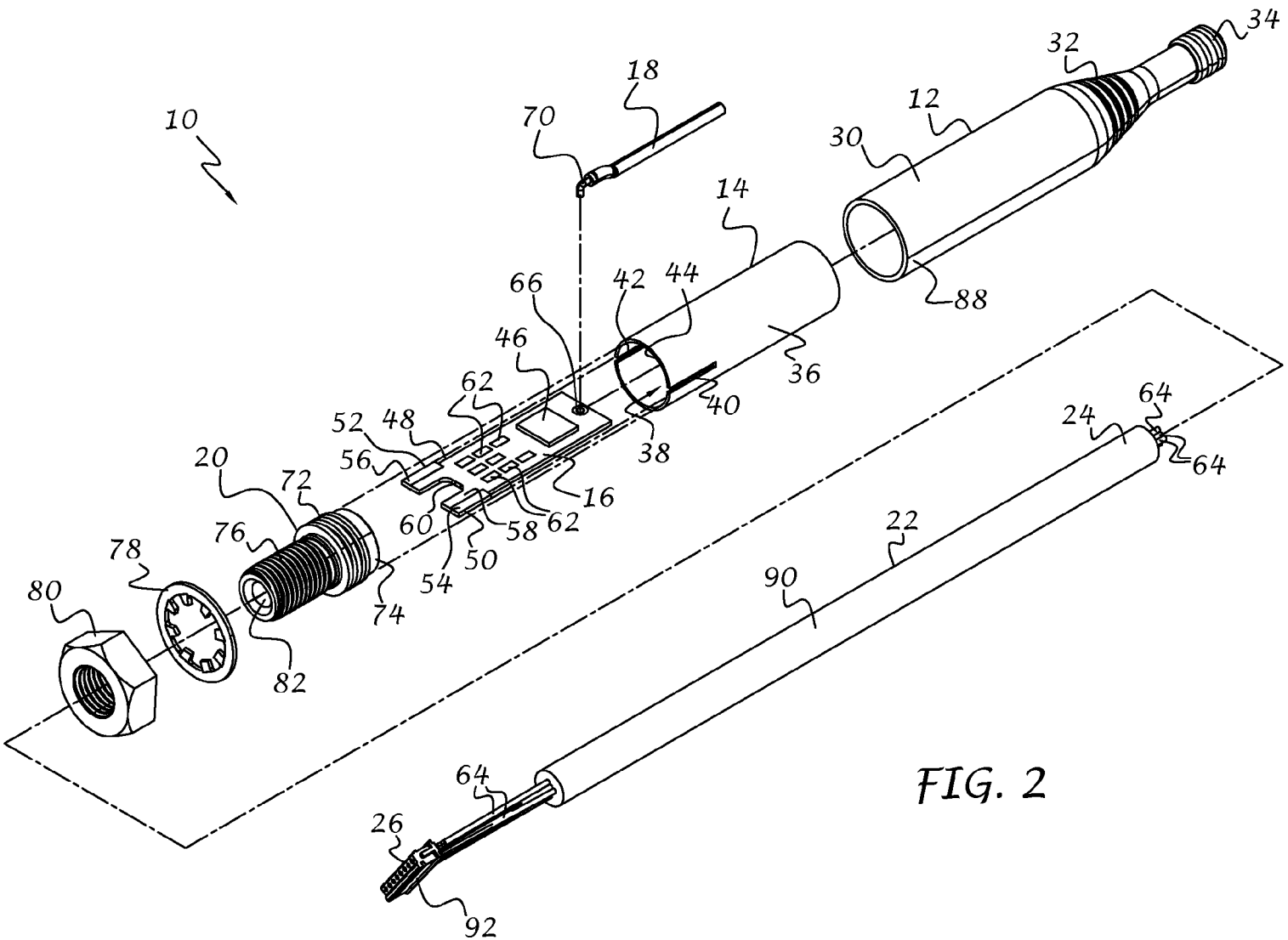
FIG. 2 is an isometric exploded view of the antenna assembly of FIG. 1.
Figure 3:
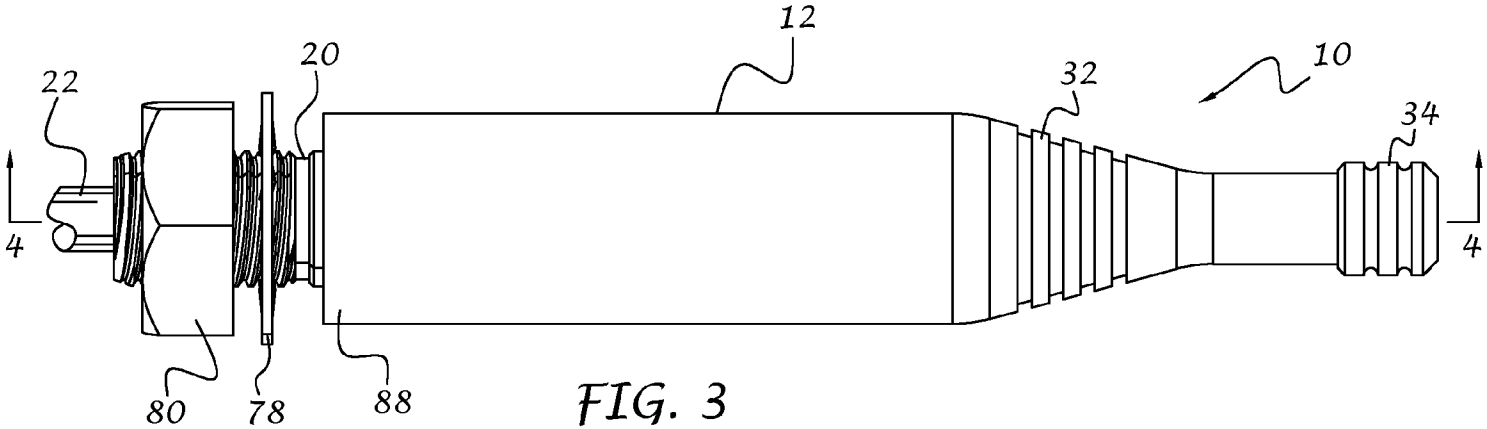
FIG. 3 is an enlarged side elevational view of a portion of the antenna assembly.
Figure 4:
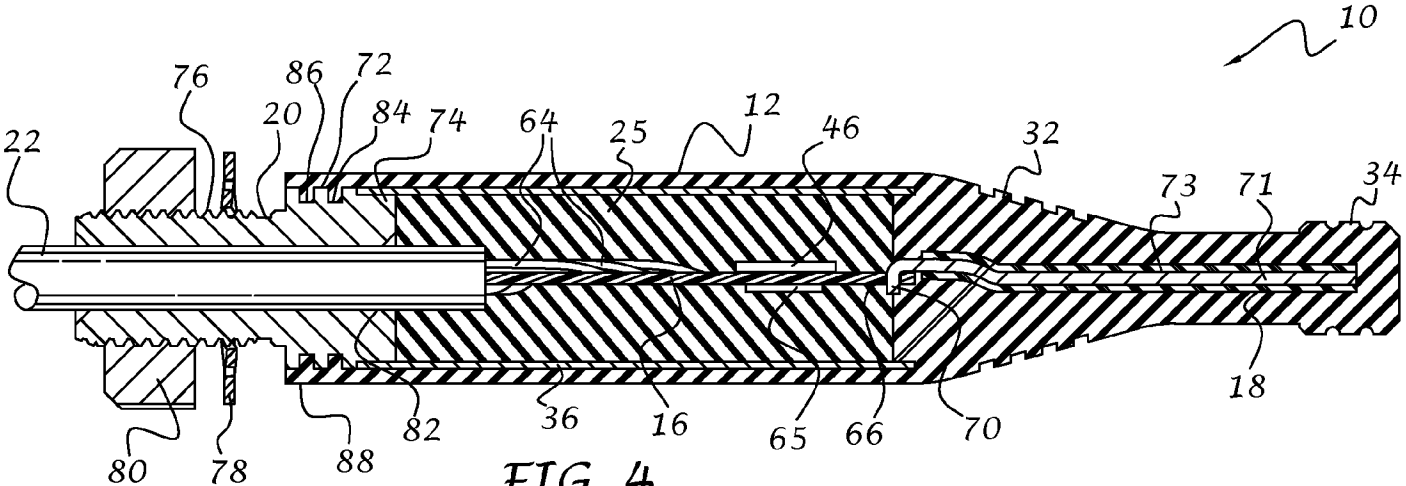
FIG. 4 is an enlarged sectional view of the antenna assembly taken along line 4-4 of FIG. 3.

During construction of the antenna assembly 10, and referring to FIG. 2, the wire assembly 22 is slid through the bore 80 of the base 20 and preferably soldered to the pads 52 of the PCB 48. The antenna 18 is soldered to the thru-hole 66. The PCB 48 with the antenna 18 are then inserted into the sleeve 14 until the tabs 50 and 52 are located in the slots 40 and 42, respectively. The pads 54, 56 of the PCB are then soldered to the wall 36 of the sleeve 14 so that the sleeve functions as a ground plane with the antenna 18 extending forwardly therefrom. The base 20 is then inserted into the sleeve 14 such that the boss 74 is in snug fit with the inner surface of the wall 36. The base 20 may then be soldered or otherwise secured to the sleeve in a well known manner. The volume 25 of potting material is then injected into the sleeve 14 so that it contacts the inner surface of the sleeve and the distal end of the base 20 and surrounds the PCB and associated electronics, including a distal portion of the wire assembly 22 so that the base and wire assembly are secured together with the PCB. This arrangement provides an especially durable construction. The volume 25 preferably comprises a two-part epoxy encapsulant having some resiliency when cured. However, it will be understood that the volume 25 may comprise other well known two-part or single part potting materials. The antenna housing 12 is then preferably directly molded onto the antenna 18, sleeve 14 and plug portion 72 of the base 20 through an overmolding process. The housing 12 protects these components from outside environmental conditions.

With the above-described arrangement, the antenna assembly 10 of the present invention has several advantages over prior art solutions. First, since the RF transceiver 46 is directly connected to the antenna 18, there are no induced power losses between the antenna and module, resulting in a very effective power transfer ratio. This is especially important in low signal areas or where battery power is of concern. Second, locating the RF transceiver 46 outside of the enclosure allows for more room inside the enclosure for other electronics and reduces the chance of interacting with the internal electronics, thus resulting in better range and performance of the RF module and antenna. In addition, the actual effective antenna is spaced from the enclosure by a distance of the length of the ground plane, in this example about 1.15 inches for a 2.4 GHz signal, to thereby reduce the effects associated with a hand holding the enclosure, thus improving the performance, range and predictability of the user's wireless system. Also, such an arrangement allows for easy retrofit of nearly any product since no internal space inside the enclosure is occupied. One need simply drill a hole in the enclosure, install the antenna assembly and wire the processed level signals and power lines to the existing electronics. Third, integrating the RF transceiver 46 into the antenna housing 12 allows processed signals to run between the antenna and other circuitry at great lengths, such as 20 feet or more, without any performance loss of the RF Module transceiver. Processed signals, whether raw or modified, may include, without limitation, logic level, analog, audio, and video signals, and so on, that are not significantly impacted by losses associated with wire length, connections, interference, and so on. For example, logic level signals represented by a "0" or "1" could switch between ground and some other voltage level such as 0V and 3V, 5V or 12V, while analog signals could range from ground to some voltage level above or below ground. In addition, such an arrangement does not require a shielded RF cable to connect to the antenna to the RF module. RF coax shielded cables are typically expensive and non-flexible relative to the standard phone or Ethernet type of wire that can be used as the wire assembly of the present invention. Accordingly, the number of parts with their attendant signal loss and expense are reduced with the provision of the present invention.

Figure 6:
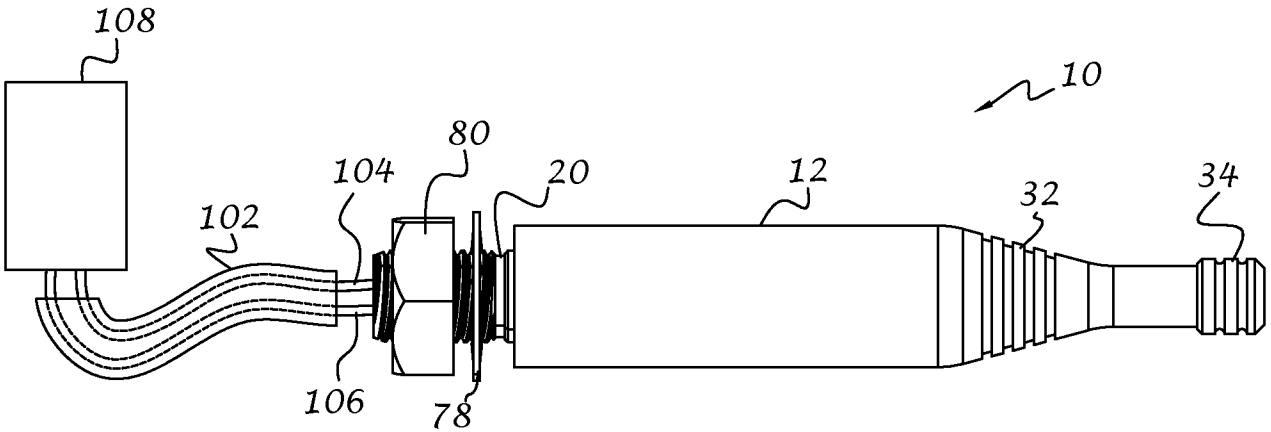
FIG. 6 is a side elevational view of an antenna assembly in accordance with a further embodiment of the invention
Figure 7:
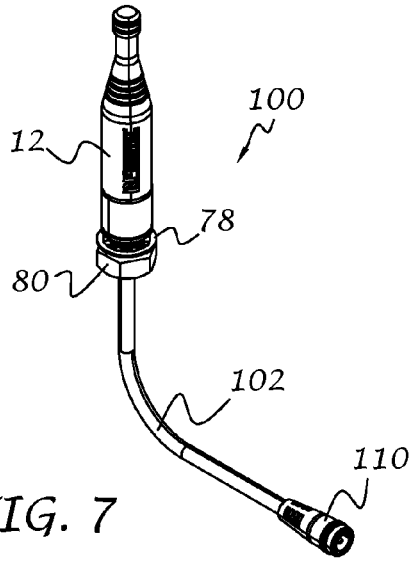
FIG. 7 is an isometric view of an antenna assembly having a coaxial termination in accordance with a further embodiment of the invention.

Turning now to FIGS. 6 and 7, an antenna assembly 100 in accordance with a further embodiment of the invention is illustrated. The antenna assembly 100 is similar in construction to the antenna assembly 10 previously described, with the exception that the wire assembly 102 has only a power wire 104 and a ground wire 106 connectable to an external power supply 108, such as a DC battery or transformer. The wire assembly 102, as shown in FIG. 7, terminates in a coaxial plug 110 for connection to the DC power supply. With this arrangement, the antenna assembly 100 can function as a repeater so that signals can be received from one device and transmitted to another device, including other antenna assemblies 100.

Figure 8:
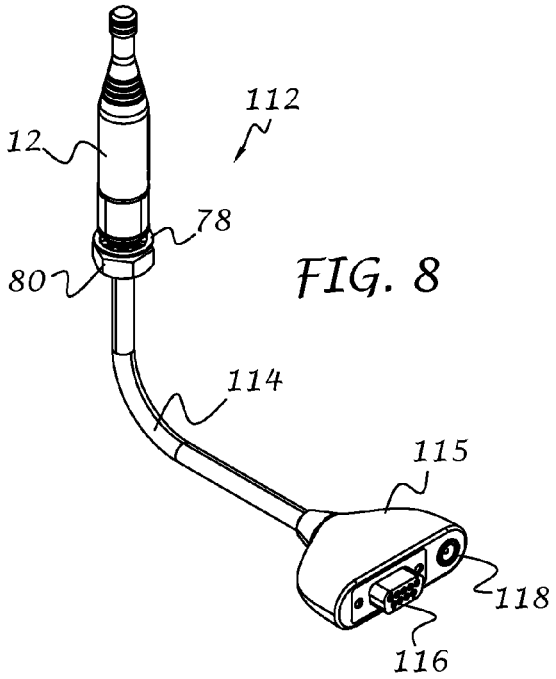
FIG. 8 is an isometric view of an antenna assembly having a serial DB-9 termination in accordance with a further embodiment of the invention.

Referring now to FIG. 8, an antenna assembly 112 in accordance with a further embodiment of the invention is illustrated. The antenna assembly 112 is similar in construction to the antenna assembly 10 previously described, with the exception that the wire assembly 114 includes 11 wires that terminate in a plug 115. The plug 115 includes a DB-9 serial interface 116 and a DC jack 118 for connecting to an external power supply. When the serial interface is connected directly to a computer, power and ground may be supplied directly through the interface so that the jack 118 can be eliminated or disregarded. Although a male-type interface is shown, it will be understood that a female-type interface can alternatively be used without departing from the spirit and scope of the present invention. In addition, other plug configurations such as a parallel-type plug can be used.

Figure 9:
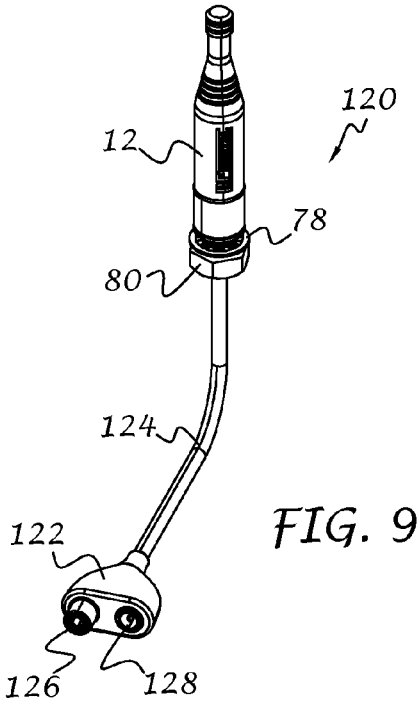
FIG. 9 is an isometric view of an antenna assembly having an RCA audio termination in accordance with a further embodiment of the invention.

Referring now to FIG. 9, an antenna assembly 120 in accordance with a further embodiment of the invention includes a plug 122 connected to a wire assembly 124. The plug 122 has an audio RCA-type jack 126 for connecting to an external audio source or electronics for receiving or transmitting audio or other signals (depending on whether the antenna assembly is transmitting or receiving) and a DC jack 128 for connecting to an external power supply. The wire assembly 124 includes four wires (not shown), two of which are associated with the jack 126 and two of which are associated with the jack 128.

Figure 10:
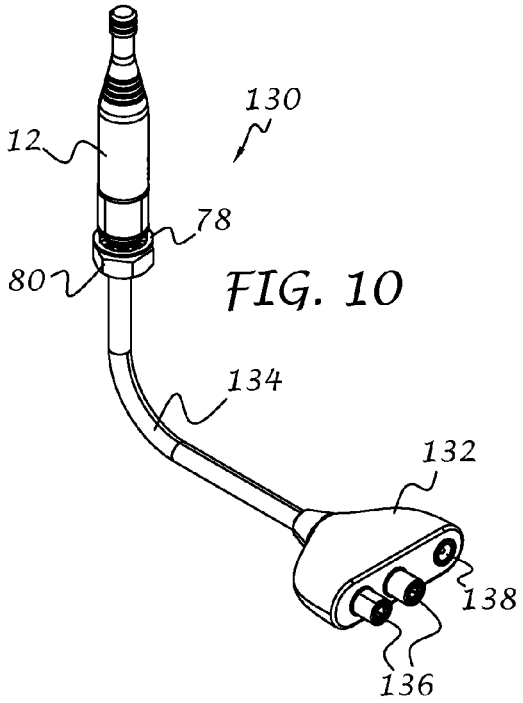
FIG. 10 is an isometric view of an antenna assembly having an RCA stereo termination in accordance with a further embodiment of the invention

Referring now to FIG. 10, an antenna assembly 130 in accordance with a further embodiment of the invention includes a plug 132 connected to a wire assembly 134. The plug 132 has a pair of audio RCA-type jacks 136 for transmitting or receiving stereo audio signals and a DC jack 138 for connecting to an external power supply. The wire assembly 134 includes six wires (not shown), two of which are associated with each jack 136 and two of which are associated with the jack 138.

Figure 11:
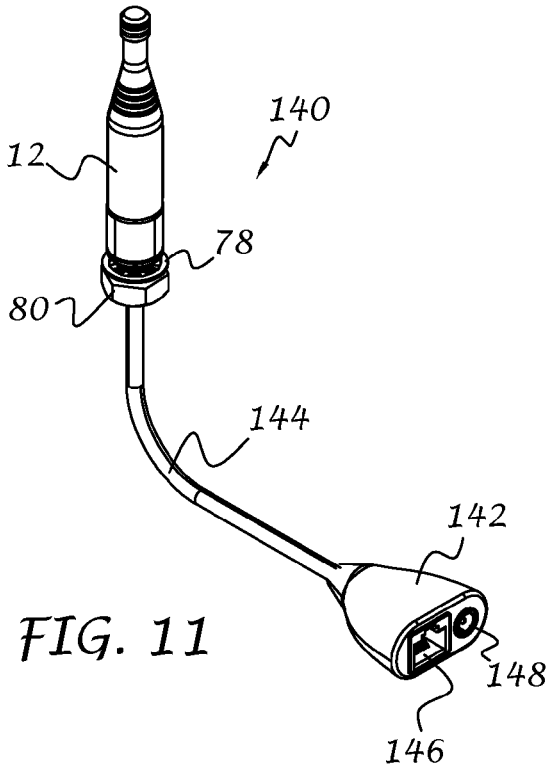
FIG. 11 is an isometric view of an antenna assembly having a telephone jack termination in accordance with a further embodiment of the invention.

Referring now to FIG. 11, an antenna assembly 140 in accordance with a further embodiment of the invention includes a plug 142 connected to a wire assembly 144. The plug 142 has an RJ-11, 12 or 14 telephone-type jack 146 and a DC jack 148. The jack 146 can be used to connect logic-level signals with the internal transceiver module (not shown in this embodiment) as previously described. The wire assembly 144 preferably includes eight wires, six of which are connected to the jack 146 and two of which are connected to the jack 148.

Figure 12:
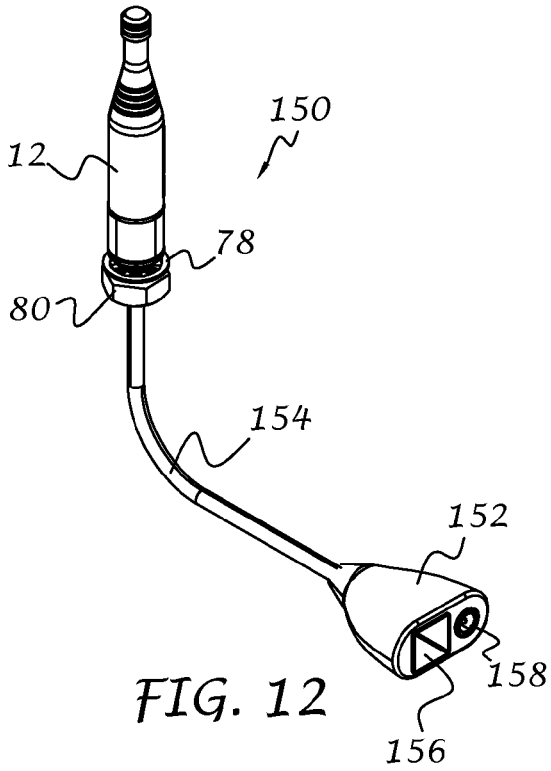
FIG. 12 is an isometric view of an antenna assembly having an Internet jack termination in accordance with a further embodiment of the invention.

Referring now to FIG. 12, an antenna assembly 150 in accordance with a further embodiment of the invention includes a plug 152 connected to a wire assembly 154. The plug 152 has an RJ-45 Internet-type jack 156 and a DC jack 158. As in the previous embodiment, the jack 156 can be used to connect logic-level signals with the internal transceiver module (not shown in this embodiment) as previously described. The wire assembly 154 preferably includes ten wires, eight of which are connected to the jack 156 and two of which are connected to the jack 158.

Figure 13:
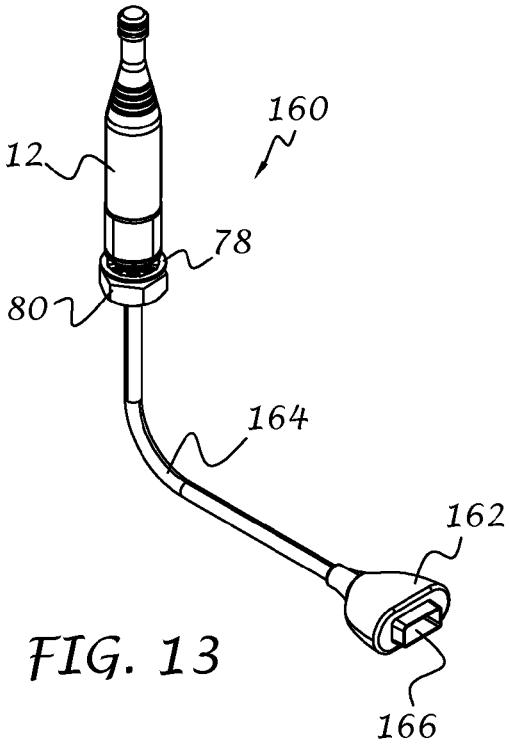
FIG. 13 is an isometric view of an antenna assembly having a USB plug termination in accordance with a further embodiment of the invention.
Figure 14:
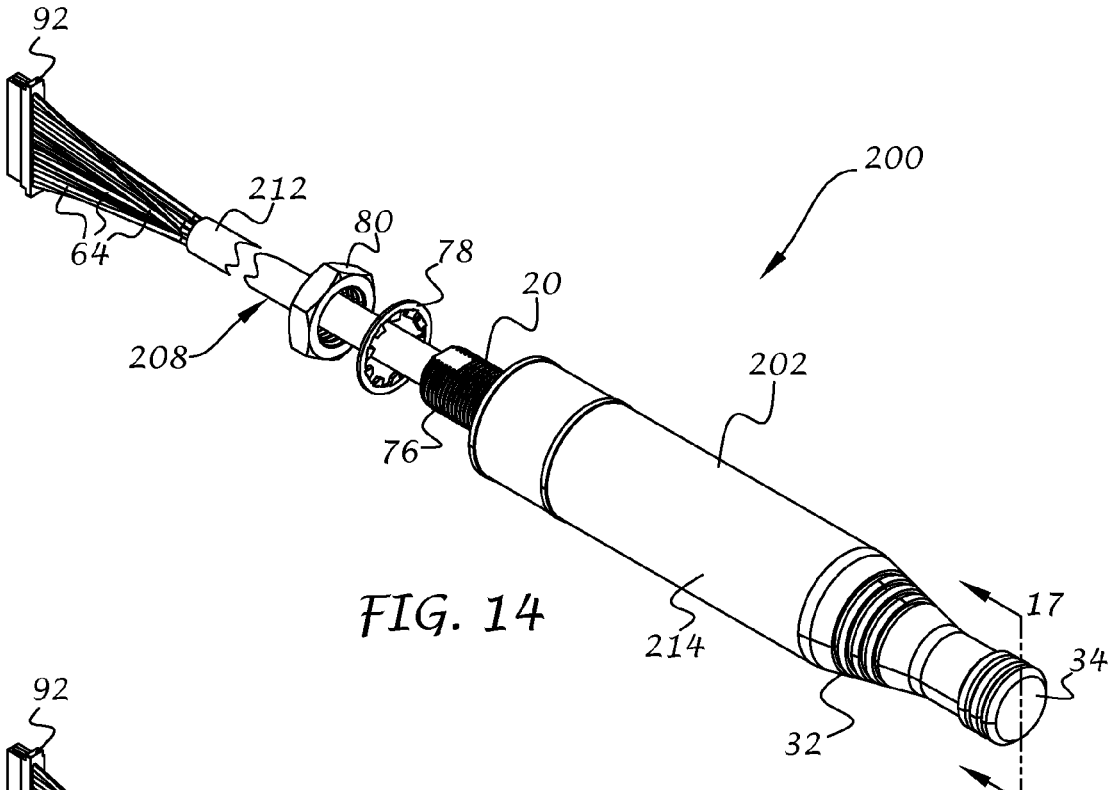
FIG. 14 is a perspective view of an antenna assembly in accordance with a further embodiment of the invention.
Figure 15:
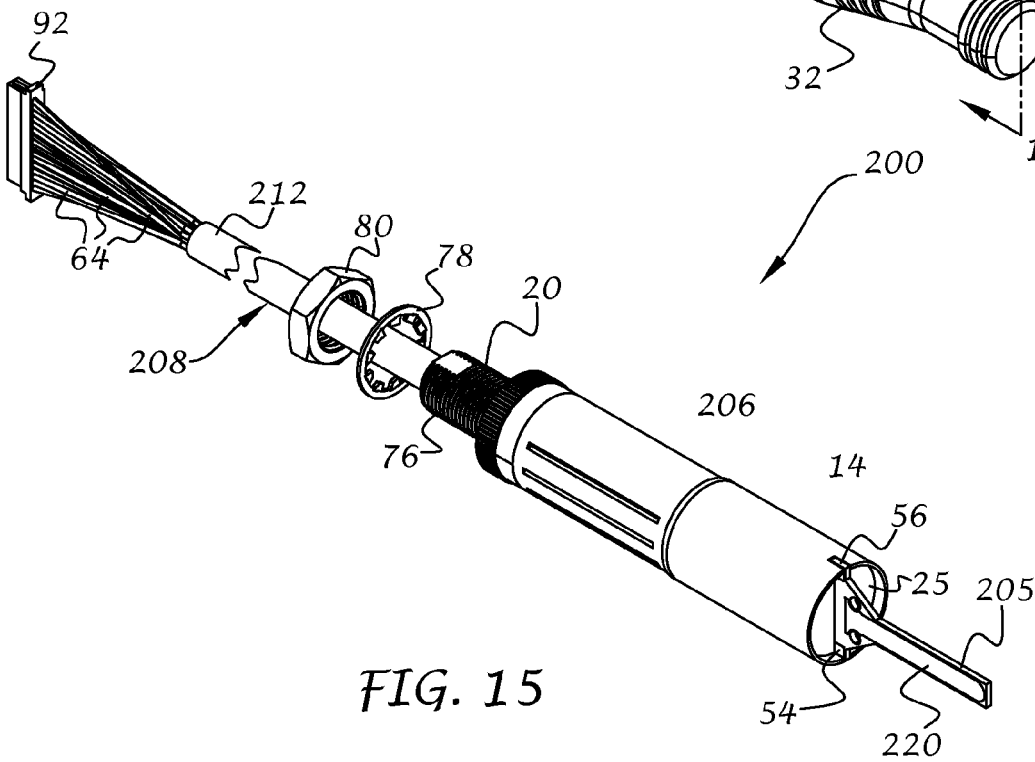
FIG. 15 is a view similar to FIG. 14 with the outer covering or housing removed to view the underlying components.
Figure 16:
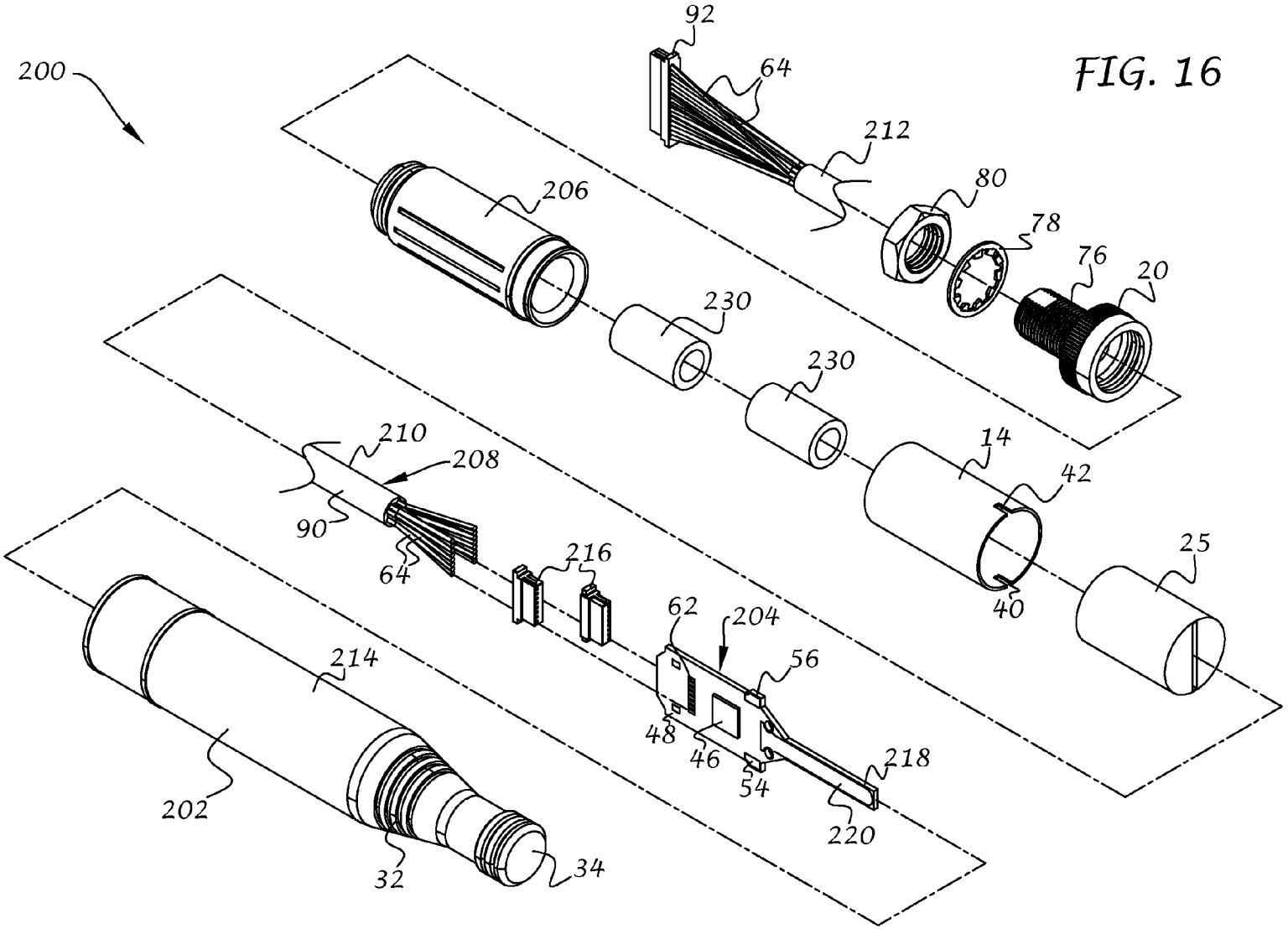
FIG. 16 is an exploded perspective view of the antenna assembly of FIG. 14.
Figure 17:
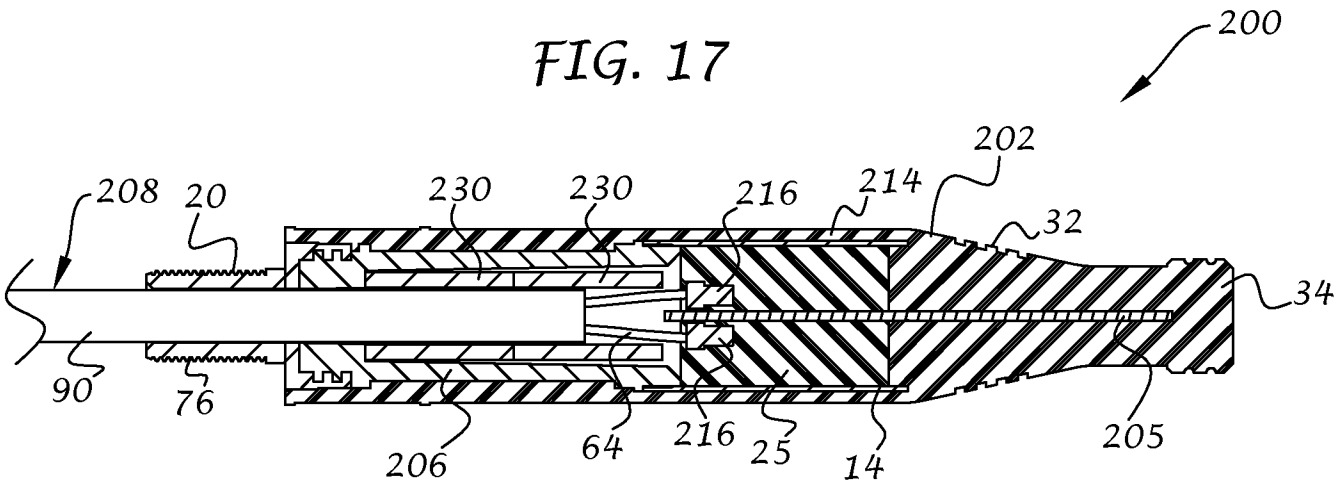
FIG. 17 is a longitudinal sectional view of the antenna assembly taken along line 17-17 of FIG. 14.

Turning now to FIG. 13, an antenna assembly 160 in accordance with a further embodiment of the invention includes a plug 162 connected to a wire assembly 164. The plug 162 has a USB or firewire jack 166 for connecting to a host or client computer or other configuration to thereby provide a wireless USB extension. Although not shown, an external DC jack could be provided where a separate power supply is required. As in the previous embodiment, the jack 166 can be used to connect logic-level signals with the internal transceiver module (not shown in this embodiment) as previously described.

Turning now to FIGS. 14-18, an antenna assembly 200 in accordance with a further embodiment of the invention is illustrated. The antenna assembly 200 is somewhat similar to the assembly 10 previously described, and therefore like designations are used to denote like parts.

The antenna assembly 200 preferably includes an antenna housing 202, a sleeve 14 located within the housing, a radio frequency (RF) module 204 located within the sleeve 14, an antenna 205 extending from the module 204, a spacer 206 extending from the sleeve 14, and a mounting base 20 extending from the spacer 206. A wire assembly 208 extends through the base 20 and includes a distal end 210 that electrically connects to the module 16 and a proximal end 212 for connection to exterior circuitry, such as circuitry 28 shown in FIG. 5. A volume 25 of potting material is positioned within the sleeve 14 and extends around the RF module 204 for both reinforcing the sleeve and providing shock absorption for the RF module. As in the previous embodiments, the conductive sleeve 14 is preferably electrically connected to the ground plane of the PCB 48, and thus the ground side of the module 204 to thereby provide a ground plane for the antenna and a shield against outside emissions.

The housing 202 is preferably similar in construction to the housing 12 previously described, in the form of an outer flexible boot with a continuous wall 214 of generally cylindrical configuration that tapers into a frusto-conical portion 32 and terminates in a cap 34 at a distal end thereof. The housing 202 can be constructed of an elastomeric material or other RF transparent material and is preferably directly molded over the antenna 205, sleeve 14, spacer 206 and base 20 through an overmolding process during assembly. The housing 202 protects these components from outside environmental conditions.

The wire assembly 208 is similar in construction to the wire assembly 22 and preferably includes an outer sheath 90 that surrounds the wires 64 and a connector 92 electrically connected to the wires 64 at the distal end 212 of the wire assembly 208. A pair of connectors 216 are located at the proximal end 210 and interface with the RF module 204.

The RF module 204 is similar in construction to the RF module 16 previously described, with the exception that the antenna 205 is formed as a longitudinal conductive trace 220 on an elongate extension 218 of the PCB 48. An electrical trace (not shown) formed on or in the PCB 48 extends between the antenna 205 and the RF module 16. In this manner, less manufacturing steps as well as greater consistency from part to part are maintained when compared to the wire antenna 18 of the previous embodiments.

Figure 18:
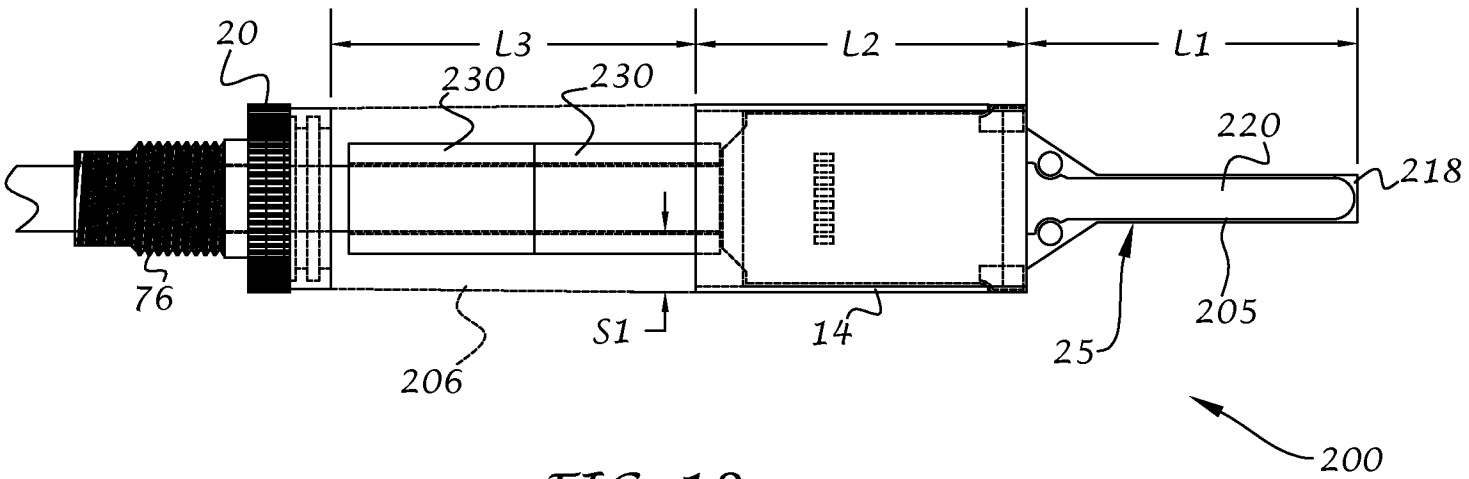
FIG. 18 is a top plan view of the antenna assembly with some components removed for clarity and showing a formed RF choke between the conductive sleeve and wire assembly.

As shown in FIG. 18, the antenna 205 can be formed with a first length L1 that is preferably equal to a one-quarter wavelength of a particular transmission/reception frequency. Likewise, the sleeve 14 can be formed with a second length L2 that is preferably equal to a one-quarter wavelength of the same frequency. The antenna 205 and sleeve 14 together create an ideal half-wave antenna. For a typical 2.4 GHz frequency range (about 2.2 GHz to about 2.6 GHz), L1 and L2 are each approximately in the range of about 25 mm to 34 mm in length. However, it will be understood that the antenna 205 and sleeve 14 can be of any size and length depending on the particular application. By way of example, for 868 MHz or 900 MHz bands an antenna 205 and sleeve 14 may be similarly sized or longer in length to accommodate the longer wavelength of 900 MHz. For example, an antenna 205 having a length L1 and sleeve 14 having a length L2 of about three inches (76 mm) may be provided. Likewise, for 433 MHz transmission, an antenna 205 and sleeve 14 can have lengths L1 and L2 of seven inches (178 mm), respectively.

The spacer 206 as shown is preferably constructed of a non-conductive material such as plastic, and has a length L3 that is at least equal to and preferably greater than the length L1 of the antenna 205. For a typical 2.4 GHz frequency range, the length L3 is preferably greater than about 25 mm. The wire assembly 208 extends through the spacer 206 and has a diameter or cross dimension that is much less than the diameter of the sleeve 14. In accordance with an exemplary embodiment of the invention, the diameter or cross-dimension of the conductive wires 64 (which include power supply and signal wires as previously described) inside the outer sheath 90 is approximately 5 mm. The diameter of the conductive sleeve 14 is approximately 16 mm. The step S1 (FIG. 18) between the sleeve 14 and bundle of wires 64 will then be approximately 11 mm. The step S1 thus creates an RF choke, where the RF electromagnetic currents traveling on the surface of the metal encounter a "step" down to the diameter of the bundle of wires 64, and thus a discontinuity in the flow of RF energy. In this manner, a dipole antenna is formed from the antenna 205 and the conductive sleeve 14. For a greater RF choke effect, the diameter of the sleeve 14 can be increased and/or the cross-dimension of the conductive wires 64 can be reduced.

With the RF module 204 (including the radio transceiver 46) located within the dipole antenna, electromagnetic energy present at the antenna is kept away from the user's application to thereby eliminate or at least substantially reduce signal interference with the user's electronics. The step S1 thus allows the antenna to properly function as a dipole with minimal impact from the cable length, position, or the users enclosure or structure to which the antenna assembly 200 is mounted to. Surprisingly, it has been found that this drastically reduces the impact of user-imposed ground effects which testing has shown that at 2.4 GHz with the exemplary lengths given for L1 and L2, would cause a less then optimal antenna pattern.

In order to further enhance the RF choke effect, one or more sleeves 230 are inserted into the spacer 206 and over the sheath 90 of the of the wire assembly 208. The sleeves 230 are preferably constructed of ferrite material, which causes further discontinuity in the flow of RF energy. In addition to the sleeves 230 or as an alternative to the sleeves, the spacer 206 can be constructed of ferrite material or have a coating of ferrite material applied to its inner or outer surfaces. Moreover, the outer sheath 90 of the wire assembly 208 can be coated with ferrite material. It is preferred that the location and volume of the ferrite material be properly balanced since too much material will draw the antenna pattern down too far and too little may not form enough of a choke to allow proper formation of the dipole antenna out of the antenna 205 and sleeve 14. Although the use of ferrite material may be preferred in some applications, it will be understood that in many applications the ferrite material may not be needed. It will be further understood that the sleeves 230 can be constructed entirely of plastic or other non-conductive material to hold the wire assembly 208 in place.

During assembly, the potting material 25 is preferably in a liquid state and flows into the conductive sleeve 14, the spacer 206, in and around the sleeves 230, and around a portion of the wire assembly 208 located in the spacer 206. When cured, the potting material holds these elements together thereby preventing vibration and adding structural strength to the antenna assembly 200.

Figure 19:
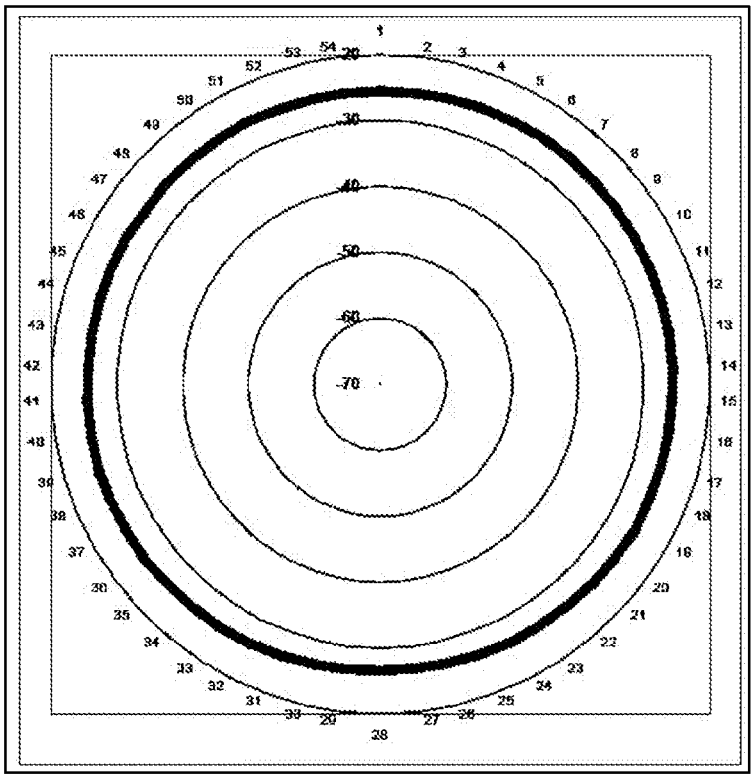
FIG. 19 is a chart of a horizontal antenna pattern from the antenna assembly of FIG. 14 and showing energy properly and evenly distributed in the horizontal plane.
Figure 20:
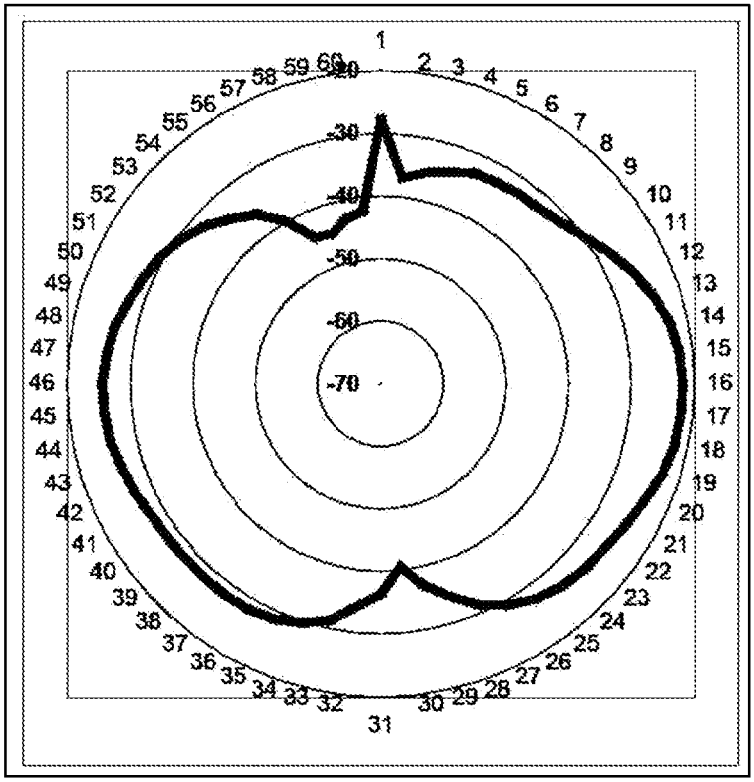
FIG. 20 is a chart of a vertical antenna pattern from the antenna assembly of FIG. 14 and showing energy distributed in the vertical plane.

Referring now to FIGS. 19 and 20, RF energy is evenly distributed in the horizontal plane (FIG. 19) and is distributed in the center of the vertical plane (FIG. 20) where the greatest effect occurs for maximum range. These near-perfect RF energy patterns are a result of the antenna assembly 200 having the exemplary dimensions described above for L1, L2, L3 and S1 for transmission/reception in the 2.4 GHz frequency range. It is believed that such transmission patterns would also be similar at different frequency ranges as discussed above, with the antenna assembly being modified with different lengths for at least L1, L2 and L3.

It will be understood that the antenna assemblies as described above can have any plug style and wire assembly configuration depending on the particular wireless application. It will be further understood that the antenna assemblies may have any desired or convenient shape such as flat, curved, coiled, and so on. It will be appreciated that the particular dimensions and frequencies set forth are by way of example only and can vary greatly over a wide range of values.

It will be further understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, the antenna can be a PCB antenna, wire or chip antennas or any other structure that functions as an antenna. It will be understood, therefore, that the present invention is not limited to the particular embodiments disclosed, but also covers modifications within the spirit and scope of the invention as defined by the appended claims.

What is claimed is:

1. An antenna assembly comprising:

an antenna housing;

an antenna located within the housing;

a radio frequency module located within the housing and including a radio frequency device selected from the group of transmitters, receivers and transceivers electrically connected to the antenna;

at least one electrical conductor operably associated with the module for conducting processed signals between the module and external circuitry without significant signal loss;

a mounting base connected to the housing for connecting the antenna assembly to an enclosure, the at least one electrical conductor extending through the mounting base;

a conductive sleeve located in the housing and surrounding the radio frequency module, the conductive sleeve being electrically connected to the module to thereby provide a ground plane for the antenna and a shield against outside emissions; and a spacer located between the housing and the mounting base for providing a radio frequency energy choke effect.

2. An antenna assembly according to claim 1, and further comprising at least one ferrite sleeve surrounding the at least one electrical conductor to thereby enhance the choke effect.

3. An antenna assembly according to claim 1, wherein a first length L1 of the antenna and a second length L2 of the conductive sleeve are approximately equal.

4. An antenna assembly according to claim 3, wherein the spacer has a third length L3 that is at least equal to or greater than the first length L1.

5. An antenna assembly according to claim 4, wherein the spacer is constructed of non-conductive material.

6. An antenna assembly according to claim 5, wherein a step S1 is formed between the conductive sleeve and the at least one electrical conductor to thereby create discontinuity in the flow of radio frequency energy.

7. An antenna assembly according to claim 1, wherein the spacer is constructed of non-conductive material.

8. An antenna assembly according to claim 7, wherein a step S1 is formed between the conductive sleeve and the at least one electrical conductor to thereby create discontinuity in the flow of radio frequency energy.

9. An antenna assembly according to claim 1, wherein the radio frequency module comprises a printed circuit board on which the radio frequency device is attached.

10. An antenna assembly according to claim 1 wherein the at least one electrical conductor extends from one end of the printed circuit board and the antenna extends from an opposite end thereof as a longitudinal extension of the printed circuit board.

11. An antenna assembly according to claim 10, wherein the conductive sleeve is electrically connected to a ground plane of the printed circuit board.

12. An antenna assembly comprising:

a conductive sleeve;

a radio frequency device located within the conductive sleeve and electrically connected thereto, the radio frequency device being selected from the group of transmitters, receivers and transceivers;

an antenna electrically connected to the radio frequency device, the antenna together with the conductive sleeve forming a dipole antenna; and at least one electrical conductor operably associated with the radio frequency device and extending coaxial with the conductive sleeve for conducting processed signals between the radio frequency device and external circuitry without significant signal loss;

whereby a step formed between the conductive sleeve and the at least one electrical conductor creates discontinuity in the flow of radio frequency energy from the dipole antenna.

13. An antenna assembly according to claim 12, and further comprising a mounting base coaxial with the conductive sleeve and a spacer extending between the mounting base and the conductive sleeve.

14. An antenna assembly according to claim 13, wherein a first length L1 of the antenna and a second length L2 of the conductive sleeve are approximately equal.

15. An antenna assembly according to claim 14, wherein the spacer has a third length L3 that is at least equal to or greater than the first length L1.

16. An antenna assembly according to claim 13, wherein the spacer is constructed of non-conductive material.

17. An antenna assembly according to claim 12, and further comprising a printed circuit board on which the radio frequency device is attached.

18. An antenna assembly according to claim 17 wherein the at least one electrical conductor extends from one end of the printed circuit board and the antenna extends from an opposite end thereof as a longitudinal extension of the printed circuit board.

19. An antenna assembly according to claim 18, wherein the conductive sleeve is electrically connected to a ground plane of the printed circuit board.

20. An antenna assembly according to claim 12, and further comprising at least one ferrite sleeve surrounding the at least one electrical conductor to thereby enhance the discontinuity.

* * * * *